United States Patent [19]

Schwartz

[11] 4,278,714

[45] Jul. 14, 1981

[54] BOW CONSTRUCTION

[75] Inventor: Herbert S. Schwartz, Raleigh, N.C.

[73] Assignee: Croscill Curtain Co. Inc., New York, N.Y.

[21] Appl. No.: 102,190

[22] Filed: Dec. 10, 1979

[51] Int. Cl.[3] ..... D04D 7/10

[52] U.S. Cl. ..... 428/4; 160/349 D

[58] Field of Search ..... 2/244; 132/47; 223/46; 160/349 R, 349 D; 428/4, 5

[56] References Cited

U.S. PATENT DOCUMENTS

| | | | |
|---|---|---|---|
| 2,103,404 | 12/1937 | Bolyard | 428/4 |
| 2,587,502 | 2/1952 | McMahon | 428/5 |
| 2,763,080 | 9/1956 | Welch | 428/5 |

*Primary Examiner*—Henry F. Epstein

*Attorney, Agent, or Firm*—Wolder, Gross & Yavner

[57] ABSTRACT

A two piece bow construction comprising a first portion which is horizontally positioned and having a closed perimeter compressed to form a flat member, and a second narrow strip portion which is knotted at the central portion of the first and the ends are dropped below the first portion, the central portion being compressed so that the ultimate appearance is that of a bow.

3 Claims, 3 Drawing Figures

BOW CONSTRUCTION

BACKGROUND OF THE INVENTION

This invention relates to a novel curtain or drapery construction and more particularly to a construction in which a bow is utilized to set off the vertical hanging portion of a curtain or drape.

In the prior technology, it has been common to have means of hooking the vertical hanging portion of the drape. This is usually done by means of a single ream of material which makes an open picture effect, but is not otherwise out of the ordinary Attempts have been made over the years to provide a more interesting type of gathering for the vertical hanging portion of the drapes, but they have not been successful from a construction point of view or a commercial point of view.

SUMMARY OF THE INVENTION

Accordingly, the principal object of the present invention is to provide a bow construction which will provide a new and novel means of gathering the hanging vertical portions of a curtain or drape.

Still yet another object of the present invention is to provide a bow construction comprising of two pieces of material, one for a substantially horizontal effect, and having means to secure behind the drape or curtain, and the other piece being substantially vertical to provide the hanging vertical ribbons.

Still yet another object of the present invention is to provide a construction which is simple and inexpensive to manufacture, and yet durable to a high degree in use.

Generally, the proposed construction consists of a horizontal piece of closed perimeter material forming a cylinder, but which is compressed against itself to form a flat member. Extending rearwardly from the central portion of the flattened perimeter are two flexible ribbons having eye-hooks at the end to engage a post in the jamb of the window.

The second portion of the ribbon is a vertical strip which is placed over the central location of the horizontal strip to form across, then the vertical strip is bent down from the top and back and one element of the ribbon is slipped through the other and the ribbons hang in the usual fashion to form a bow. The ribbons are pulled tight to compress the horizontal strip at its central location to give the affect of a bow.

DESCRIPTION OF THE PREFERRED EMBODIMENT

Figure 1:
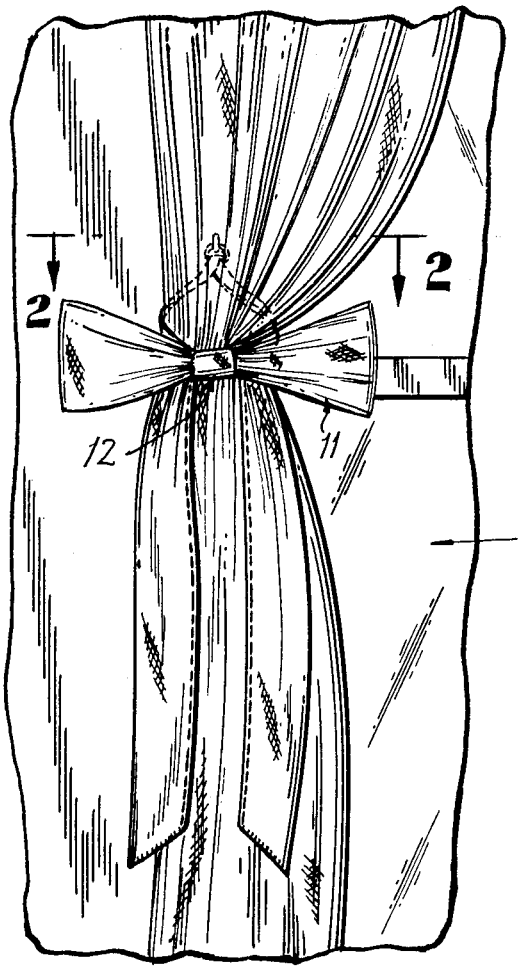
FIG. 1 is a fragmentary vertical elevational view of a portion of a curtain or drapery showing the invention in position.
Figure 3:
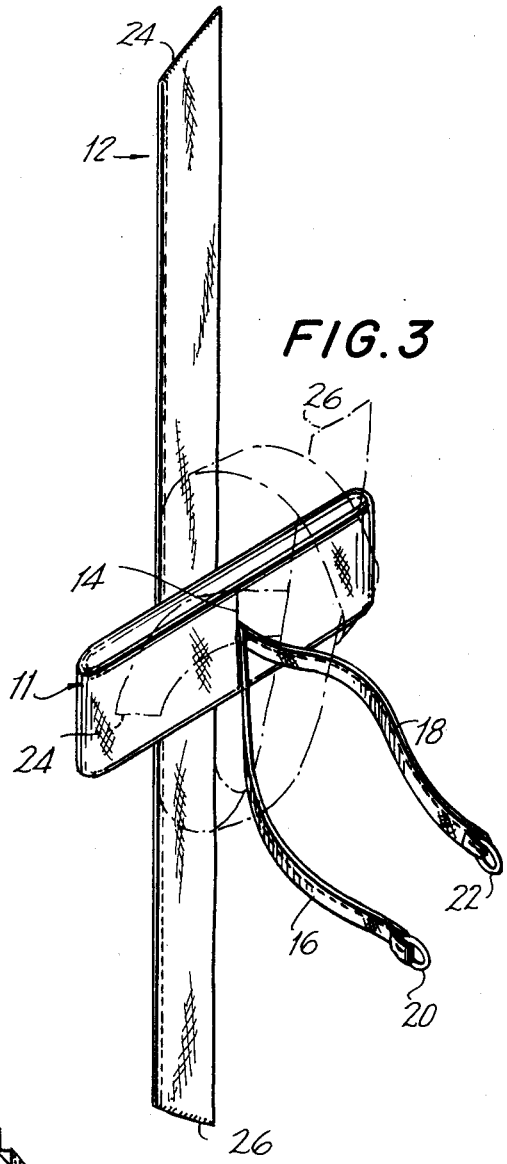
FIG. 3 is a view showing the two elements of the invention in their normal spread position prior to assembly, and in partial assembly in phantom.

Turning in detail to the drawings, and more particularly to FIG. 1, there is shown a bow construction 10 comprising a horizontal strip 11 (FIG. 3) and a vertical strip 12. The horizontal strip consists of a closed perimeter piece of material which is cylindrical in configuration, and which is flattened against itself as best seen in FIG. 3. Extending from the rear of the horizontal strip and at the median fold line 14 thereof, are two ribbons 16, 18 having eye-hooks 20, 22 secured to the ends thereof .

The second portion of the invention consists of the vertical strip 12 which is essentially trapezoidal in configuration. The strip has an upper end 24 and a lower end 26.

Figure 2:
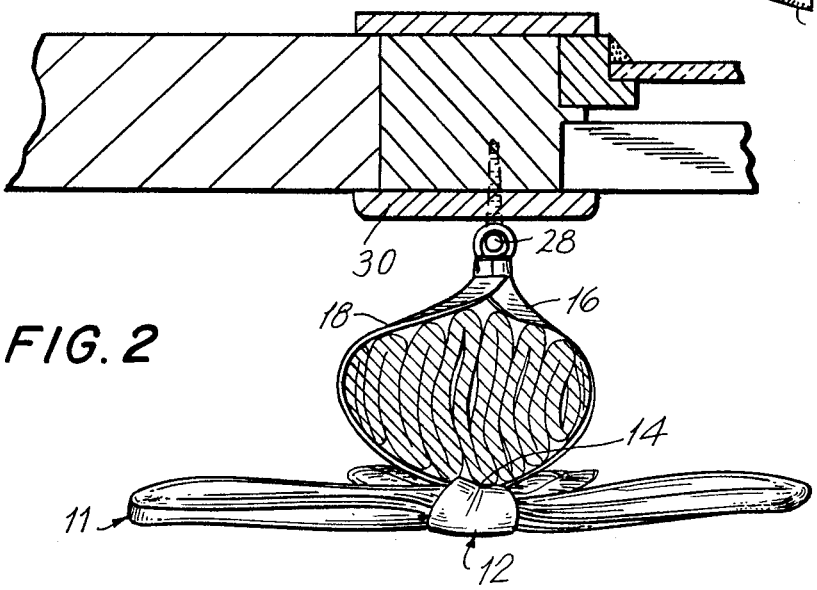
FIG. 2 is an enlarged fragmentary cross-sectional view taken along the line 2—2 of FIG. 1.

As shown in phantom, during assembly, the vertical strip is placed in a flattened position and a horizontal strip is placed on top, approximately at the middle point of the vertical strip and meeting it at approximately the middle point of the horizontal strip. The horizontal strip is then flattened against the vertical strip. The ends 24, 26 are directed downwardly and upwardly with the strip 24 passing around and underneath the strip 26 as shown in phantom. The ends are then pulled tightly to squeeze and compress the central portion of the horizontal strip 11 and the ends hand downwardly, with the completed unit as shown in FIG. 1. The unit is then placed along the vertical length of a curtain or drapery as shown in FIG. 2 and the eye-hooks are positioned upon a convenient mating hook 28 secured to the jamb 30 of a window. The overall unit presents a pleasing appearance, and represents a simple construction which is a significant advance in the state of the art for curtain supports.

While there has been described and illustrated a preferred embodiment of the present invention, it is apparent that numerous alterations, omissions and additions may be made without departing from the spirit thereof.

I claim:

1. A bow construction for gathering the vertical length of a curtain or drapery which comprises:

a horizontal strip which is essentially rectangular in appearance;

a vertical strip, the strip being abutted against the front of the horizontal strip and knotted therebehind, whereby the ends of the vertical strip hang downwardly below the horizontal strip and the central portion of the horizontal strip is compressed so that the appearance is that of a bow; and the horizontal strip has depending therefrom at least two ribbons, the ribbons having detachable hook means at the ends thereof to be received on a support member to properly and positively locate the bow construction along the vertical length of the curtain or drapery.

2. The invention according to claim 1, the horizontal strip having a closed perimeter construction and being essentially cylindrical in configuration and appearing rectangular when flat.

3. The invention according to claim 1, the vertical strip being trapezoidal in configuration and having an upper and lower end.

* * * * *